US006180593B1

(12) United States Patent
Fender et al.

(10) Patent No.: US 6,180,593 B1
(45) Date of Patent: Jan. 30, 2001

(54) FABRIC SOFTENERS WITH IMPROVED COLOR-RETAINING ACTION

(75) Inventors: Michael Fender, Flieden; Hans-Jürgen Köhle, Schlüchtern; Anja Wilhelm, Steinau an der Strasse, all of (DE)

(73) Assignee: Goldschmidt Rewo GmbH & Co. KG, Steinau a.d. Strasse (DE)

( * ) Notice: Under 35 U.S.C. 154(b), the term of this patent shall be extended for 0 days.

(21) Appl. No.: 09/377,390

(22) Filed: Aug. 19, 1999

(30) Foreign Application Priority Data

Sep. 30, 1998 (EP) ..... 98118491

(51) Int. Cl.[7] ..... C11D 1/645; C11D 1/835
(52) U.S. Cl. ..... 510/515; 510/504
(58) Field of Search ..... 510/515, 516, 510/521, 522, 500, 504

(56) References Cited

U.S. PATENT DOCUMENTS

| | | | | |
|---|---|---|---|---|
| 3,974,076 | * | 8/1976 | Wiersma et al. | 252/8.8 |
| 5,242,607 | * | 9/1993 | Yamamura et al. | 252/8.6 |
| 5,500,138 | * | 3/1996 | Bacon et al. | 252/8.8 |

FOREIGN PATENT DOCUMENTS

| | | | |
|---|---|---|---|
| 0 341 205 A2 | | 11/1989 | (EP) . |
| 374609 A2 | * | 12/1989 | (EP) . |
| 0 462 806 B1 | | 12/1991 | (EP) . |
| 510879 A2 | * | 10/1992 | (EP) . |
| 0 704 523 A1 | | 4/1996 | (EP) . |
| 0 811 679 A1 | | 12/1997 | (EP) . |
| 4-100974 | * | 2/1992 | (JP) . |
| 7-70927 | * | 3/1995 | (JP) . |
| 9-255988 | * | 9/1997 | (JP) . |
| WO 94/11482 | | 5/1994 | (WO) . |

* cited by examiner

*Primary Examiner*—John R. Hardee
(74) *Attorney, Agent, or Firm*—Scully Scott, Murphy & Presser

(57) ABSTRACT

The invention relates to fabric softeners with color-retaining action comprising: 3–25%, by weight, of component (A) consisting of Aa) 75–97%, by weight, of quaternary ammonium compounds of the general formula (I)

Aa1)

and 3–25%, by weight, of at least one other compound Ab); (B) 0.5–6%, by weight, of customary auxiliaries and additives; and (C) ad 100%, by weight, of water.

4 Claims, 1 Drawing Sheet

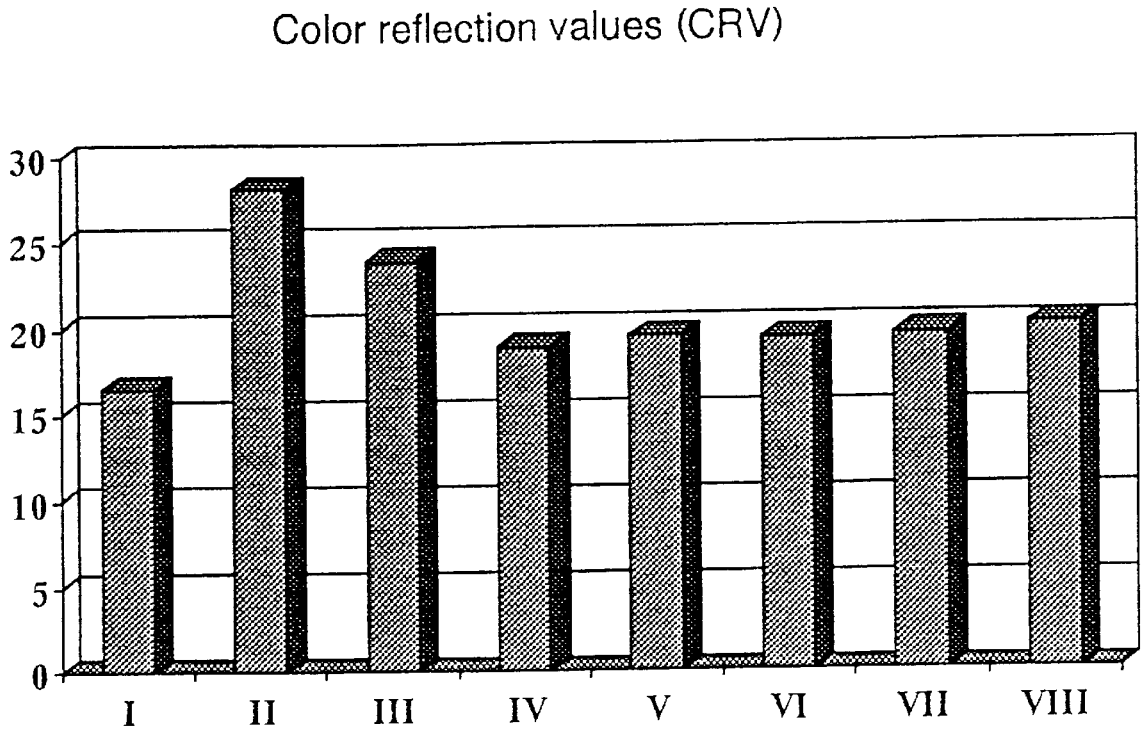
Figure

FABRIC SOFTENERS WITH IMPROVED COLOR-RETAINING ACTION

FIELD OF THE INVENTION

The present invention relates to fabric softener formulations based on one or more cationic surfactants and at least one other component which impart to the overall formulation improved color-retaining action on textiles.

BACKGROUND OF THE INVENTION

Over time, the detergent industry has developed textile detergents having continuously improved detergency. Although this is positive and desirable for hygienic reasons, the adverse effect, particularly after a number of wash cycles, cannot be overlooked; colored textiles or textiles imprinted with color undergo fading to a greater or lesser extent.

Color leaching is even more undesirable if the dyes released into the wash liquor are transferred onto other textiles.

Attempts have therefore been made in the past to solve the problem in various ways, such as, for example, by treating the textiles with "dye scavengers" during the washing operation.

The use of color fixatives, which are intended to improve adhesion of the dyes to the fiber, and which are added to the detergent or to the rinse, has also been proposed on several occasions (EP-A-0 704 523, EP-A-0 341 205, EP-A-0 462 806, WO 94/11482, EP-A-0 811 679).

Some progress has been made, but primarily only as a result of high fixative concentrations of about 5–8%, by weight. There is thus a continued need for laundry fabric softeners which have reduced concentrations of fixatives coupled with a high color-retaining action.

SUMMARY OF THE INVENTION

It has now been found that a fabric softener formulation consisting primarily of cationic surfactants and at least 0.02 to about 4%, by weight, based on the overall formulation, of another compound satisfies these requirements, i.e. the colors are fixed on the fabric by the fabric-softening operation so that during the next washing operation bleeding is greatly reduced.

Specifically, the present invention provides fabric softeners with color-retaining action comprising:

3–25%, by weight, of component (A) which consists of:

Aa) 75–97%, by weight, of quaternary ammonium compounds of the general formula (I)

(I)

Aa1

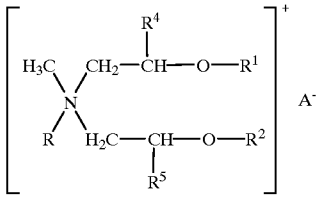

and 3–25%, by weight, of at least one of the compounds (II)

Ab1)

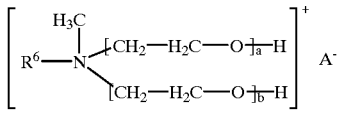

(III)

Ab2)

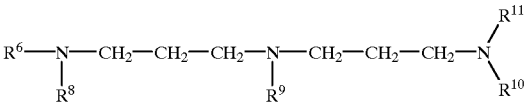

(IV)

Ab3)

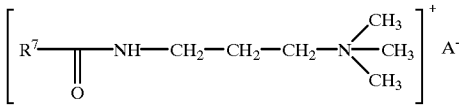

(V)

Ab4)

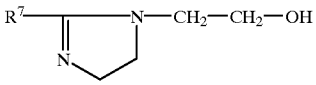

where

R=—$CH_3$, —$CH_2$—CH($R^4$)—O$R^1$, —$CH_2$—CH($R^5$)—O$R^2$, wherein $R^4$ and $R^5$ may be identical or different and can be H or —$CH_3$, $R^1$,$R^2$=H,—C(O)—$R^3$, wherein $R^3$ is an optionally substituted hydrocarbon radical which may or may not contain double bonds and has 13–19 carbon atoms, with the proviso that at least 1–1.5 of $R^1$ and $R^2$=H, $R^6$=an optionally substituted hydrocarbon which may or may not contain multiple bonds and which has 8–20 carbon atoms, a,b=1–8, where the sum a+b is 2–10, in particular 3–8, $R^7$=an optionally substituted hydrocarbon radical having 7–19 carbon atoms, $R^{8-11}$=—($CH_2$—$CH_2$—O)$_n$H, wherein n is =1–10 and the sum of all n is =8–20, in particular 11–15, $A^-$=is an anion of a quaternizing agent, in particular of dimethylsulfate, diethylsulfate, or methylchloride;

(B)0.5–6%, by weight, of customary auxiliaries and additives; and (C) ad 100%, by weight, of water.

The invention further provides aqueous fabric softeners in which the alkanolamines are methyldiethanolamine or triethanolamine.

The invention further provides aqueous fabric softeners based on esters of fatty acids and alkanolamines which are reacted in a molar ratio from 1:1.75 to 1:2. Other subject-matters provided by the invention are defined by the claims.

BRIEF DESCRIPTION OF THE DRAWINGS

The sole FIG. is a bar graph of color reflection values (CRV) for washed articles in the example.

DETAILED DESCRIPTION OF THE INVENTION

The quaternary compounds of the general formula I used according to the present invention are prepared by processes generally known in this field, e.g. by esterification of alkanolamines such as triethanolamine (TEA), methyldiethanolamine (MDEA), methyldiisopropanolamine (MDIA), methylethanolisopropanolamine (MEIPA), triisopropanolamine (TIPA) with a fatty acid and subsequent quaternization.

Particularly widespread are ester compounds based on triethanolamine, such as N-methyl,N,N-bis(beta-$C_{14-18}$-acyloxyethyl), N-beta-hydroxyethylammonium methosulfate), which are sold under tradenames such as TETRANYL®AT 75 (trademark of KAO Corp.), STEPANTEX®VRH 90 (trademark of Stepan Corp.) or REWOQUAT™WE 18 (trademark of Witco Surfactants GmbH).

The fatty acids used for the esterification or transesterification are the monobasic fatty acids which are known and are customary in this field. Specifically, the fatty acids are based on natural vegetable or animal oils having 12–22 carbon atoms, in particular 14–18 carbon atoms, such as palm, tallow, castor fatty acids with iodine numbers in the range from 20 to 80, in particular from 30 to 50, in the form of their glycerides, methyl or ethyl esters, or as free acids.

The content of unsaturated moieties in these fatty acids or fatty acids esters is, if necessary, adjusted to the desired iodine number by means of the known catalytic hydrogenation processes, or achieved by mixing completely hydrogenated with nonhydrogenated fatty components.

The iodine number, a measure of the average degree of saturation of a fatty acid, is the amount of iodine which is taken up by 100 g of the compound to saturate the double bonds.

According to the invention, preference is given to partially hydrogenated tallow fatty acids and palm fatty acids. They are commercially available products and are supplied by various companies under their respective tradenames. The esterification or transesterification is carried out by known processes. To this end, the alkanolamine is reacted with the amount of fatty acid or fatty acid esters which corresponds to the desired degree of esterification, optionally in the presence of a catalyst, e.g. methanesulfonic acid, under nitrogen at 160°–240° C., and the water of reaction which forms or the alcohol is continuously distilled off. During esterification or transesterification, it is possible to reduce the pressure, if necessary, in order to complete the reaction.

According to the present invention, the ratio is preferably chosen such that the diesters are predominantly present in the technical-grade reaction mixtures.

The subsequent quaternization is also carried out by known processes. The process of the present invention involves adding equimolar amounts of the quaternizing agent to the ester, optionally in the presence of a solvent, preferably isopropanol, ethanol, 1,2-propylene glycol and/or dipropylene glycol, at 60°–90° C. with stirring, and optionally under pressure, and monitoring completion of the reaction by checking the overall amine number.

Examples of quaternizing agents which can be used are organic or inorganic acids, but preferably short-chain dialkyl phosphates and dialkyl sulfates, such as, in particular, dimethyl sulfate, diethyl sulfate, dimethyl phosphate, diethyl phosphate, short-chain halogenated hydrocarbons, in particular methylchloride.

The fatty acids listed below were used for preparing the quaternary ammonium compounds according to the general formula (I).

Fatty Acid I(FAI)

Partially hydrogenated tallow fatty acid having an acid number of 202–208, an iodine number of 36–44 and a carbon chain distribution as follows:

| | |
|---|---|
| <C 16 | ca. 2% |
| C 16 | ca. 25% |
| C 16' | ca. 2% |
| C 17 | ca. 2% |
| C 18 | ca. 28% |
| C 18' | ca. 37% |
| C 18" | ca. 3% |
| >C 18 | ca. 2% |

Fatty acid II(FAII)

Partially hydrogenated palm fatty acid having an acid number of 205–212, and iodine number of 32–40 and a carbon chain distribution as follows:

| | |
|---|---|
| <C 16 | ca. 2% |
| C 16 | ca. 46% |
| C 16' | ca. 1% |
| C 17 | — |
| C 18 | ca. 13% |
| C 18' | ca. 36% |
| C 18" | ca. 2% |
| >C 18 | ca. 1% |

Examples of the quaternary ammonium compounds according to formula (I) used were the following compounds:

Component Aa1): TEA:FAI=1:1.75

Component Aa2): TEA:FAII=1:1.85

Component Aa3): MDEA:FAI=1:2

The compounds according to Ab) can be prepared by processes known per se.

For example, component Ab1) is preferably prepared by reaction of primary alkylamines with ethylene oxide and subsequent quaternization with an alkylating agent, such as, for example, dimethyl sulfate. According to the present invention, preference is given to compounds based on cocoamine having a total of 3–8 added ethylene oxide molecules.

Component Ab2) is preferably prepared by reaction of alkyldipropylenetriamine with ethylene oxide, where, according to the present invention, alkyl radicals having 18 carbon atoms and a total amount of added ethylene oxide molecules (sum n) of 11–15 are preferably used.

Component Ab3) is obtainable by reaction of dimethylaminopropylamine with long-chain fatty acids such as, preferably, coconut fatty acid and in particular tallow fatty acid, in a molar ratio of 1:1, and subsequent quaternization with an alkylating agent such as, for example, dimethyl sulfate.

Component Ab4) is preferably prepared by reaction of aminoethylethanolamine with a long-chain fatty acid in a molar ratio of 1.5:1 and subsequent distillation of the excess aminoethylethanolamine; the amide cyclizing to give the imidazoline with the elimination of water.

The fabric softeners are prepared by emulsifying or dispersing the respective individual components in water.

For this, it is possible to use the procedures customary in this field.

In the present invention, the fabric softeners are usually prepared by taking an initial charge of water preheated to about 10° C. below the clear melting point of the fabric softener and then, with thorough stirring, dispersing therein firstly the dye solution, then the antifoam emulsion which may or may not be required and finally the clear melt of the fabric softener and of component Ab) as a mixture or in any desired sequence. After some of the electrolyte solution has been added, perfume oil is metered in, followed by the remaining electrolyte solution, and then the mixture is left to cool to room temperature with stirring.

The fabric softeners of the invention can comprise the given components within the limits customary in this field, such as, for example, 3–25%, by weight, of a mixture of the compounds of the general formula I with at least one compound of the general formulae II to V; 0.5 to 6%, by weight, of customary auxiliaries and additives, such as 0.1–1%, by weight, of dyes, 0.1–1%, by weight, of preservatives, 0.1–1%, by weight, of antifoams and, in particular, 0.1–1.5%, by weight, of an alkali metal and/or alkaline earth metal salt; 0.1–1.5%, by weight, of perfume oil, the remainder to 100%, by weight, (ad 100) being water.

Like the fabric softeners which are part of the known prior art, the fabric softeners of the present invention are added in the last rinse cycle following the actual washing operation. Depending on the application field, the use concentration is, following dilution with water, in the range of 0.1–10 g of fabric softener per liter of treatment liquor.

The following example is given to illustrate the present invention and to demonstrate some advantages that can arise from utilizing the same.

EXAMPLE

| | | | |
|---|---|---|---|
| (1) | Component Aa1) | TEA:FAI = 1:1.75 | 90% |
| | Component Ab1) | where R6 = cocoalkyl, a + b = 5 and A = methylsulfate | 10% |
| (2) | Component Aa1) | TEA:FAI = 1:1.75 | 92% |
| | Component Ab2) | where $R^6$ = tallow alkyl and $R^8 + R^9 + R^{10} + R^{11} = 13$ A = methylsulfate | 8% |
| (3) | Component Aa1) | TEA:FAI = 1:1.75 | 92% |
| | Component Ab3) | where $R^7$ = nor-tallow alkyl A = methylsulfate | 5% |
| | Component Ab1) | where $R^6$ = cocoalkyl, a + b = 5 and A = methylsulfate | 3% |
| (4) | Component Aa2) | TEA:FAII = 1:1.85 | 90% |
| | Component Ab1) | where $R^6$ = cocoalkyl, a + b = 5 and A = methylsulfate | 10% |
| (5) | Component Aa3) | MDEA:FAI = 1:2 | 90% |
| | Component Ab4) | where $R^7$ = nor-cocoalkyl | 10% |

Tests

To test the color loss of the colored test fabric, the latter was subjected to 10 wash cycles, fabric softening and drying being carried out after each wash. Before the first wash, and also after the 5th and 10th drying, the color intensity (light reflection) of the test fabric was measured.

Test conditions:

Apparatus: Laboratory washing machine: Linitest® (Heraeus)

Colored Fabric: Cotton fabric with sulphur dye Sulfur Black 1, (Sandozol® Black 4G-RDT)

Laundry: 1.5 g of colored fabric

Detergent: Persil® Color Gel (Henkel)

Amount: 10 g/l

Liquor amount: 150 ml

Wash temperature: 40° C.

Wash time: 45 minutes

Aftertreatment: Fabric softener: according to the example formulations

Amount of fabric softener used: 1.75 g/l

Rinse temperature: 20° C.

Rinse time: 10 minutes

Drying time: 24 hours

Measuring device:

Lico 200, Dr. Lange; measurement method: according to manufacturer's instructions.

The measured values given in the figure of the present invention are the light reflection values (measured values) determined using the following measuring device: A xenon flash lamp is used to flash a defined beam of light onto the sample body. In accordance with DIN 5033, the diffuse reflection of the sample at an angle of 8° is measured. The measured values are in direct relation to the intensity of a dye. Low reflection values represent dark colors, i.e. the lower the value, the lower also the color release and the more effective the fabric softener formulation.

The following key applies to the sole figure of the present invention:

I=unwashed reference textile—(CRV 16.5)

II=washed 10 times, not fabric softened—(CRV 28.1)

III=washed 10 times, fabric softened using a commercially available fabric softener based on Aa1)—(CRV 23.9)

IV=washed 10 times, fabric softened using example formulation (1)—(CRV 18.9)

V=washed 10 times, fabric softened using example formulation (2)—(CRV 19.5)

VI=washed 10 times, fabric softened using example formulation (3)—(CRV 19.4)

VII=washed 10 times, fabric softened using example formulation (4)—(CRV 19.6)

VIII=washed 10 times, fabric softened using example formulation (5)—(CRV 20.1)

While the present invention has been particularly shown and described with respect to preferred embodiments thereof, it will be understood by those skilled in the art that the foregoing and other changes in form and detail may be made without departing from the spirit and scope of the present invention. It is therefore intended that the present invention not be limited to the exact forms described and illustrated but fall within the scope of the present invention.

What is claimed is:

1. A fabric softener with color-retaining action comprising 3–25%, by weight, of component A which consists of 75–97%, by weight, of quaternary ammonium compounds of the general formula (I)

(I)

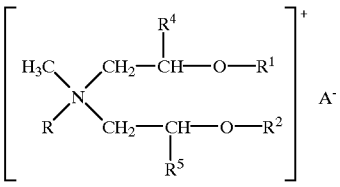

and 3–25%, by weight, of at least one a compound having the general formula (II):

(II)

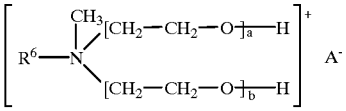

where R is —$CH_3$,—$CH_2$—CH($R^4$)—O$R^1$, or —$CH_2$—CH($R^5$)—O$R^2$, wherein $R^4$ and $R^5$ may be identical or different and can be H or —$CH_3$; $R^1$ and $R^2$ are independently H or —C(O)—$R^3$, wherein $R^3$ is a hydrocarbon radical which may or may not contain double bonds and has 13–19 carbon atoms, with the proviso that at least 1–1.5 of $R^1$ and $R^2$ is H; $R^6$ is cocoalkyl; a and b each is a number from 1–8, wherein the sum a+b is 2–10; and A is an anion of a quaternizing agent selected from the group consisting of phosphates, sulfates and halogens;

0.5–6%, by weight, of component B which consists of customary auxiliaries and additives; and 100%, by weight, of component C which is water.

2. The fabric softener of claim 1 wherein a+b=5 and A is methylsulfate.

3. A fabric softener with color-retaining action comprising 3–25%, by weight, of component A which consists of 75–97%, by weight, of quaternary ammonium compounds of the general formula (I)

(I)

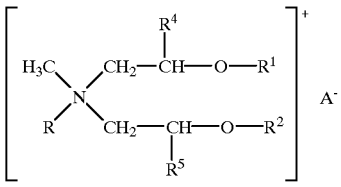

and 3–25%, by weight, of at least one compound having the general formula (III):

(III)

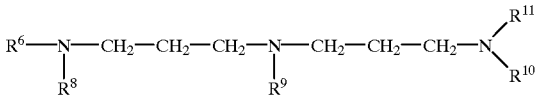

wherein

R is —$CH_3$,—$CH_2$—CH($R^4$)—O$R^1$, or —$CH_2$—CH($R^5$)—O$R^2$, wherein $R^4$ and $R^5$ may be identical or different and can be H or -$CH_3$; $R^1$ and $R^2$ are independently H or, —C(O)—$R^3$, wherein $R^3$ is a hydrocarbon radical which may or may not contain double bonds and has 13–19 carbon atoms, with the proviso that at least 1–1.5 of $R^1$ and $R^2$ are H; $R^6$ is tallow alkyl; a and b each are numbers from 1–8, wherein the sum of a+b=10; $R^{8-11}$ are independently —($CH_2$—$CH_2$—O)$_n$H, where n is =1–10 and the sum of all n is =8–20;

0.5–6%, by weight, of component B which consists of customary auxiliaries and additives; and 100%, by weight, of component C which is water.

4. The fabric softener of claim 3 wherein the sum of all n is 13.

* * * * *